United States Patent [19]

Masuda et al.

[11] 4,357,150

[45] Nov. 2, 1982

[54] HIGH-EFFICIENCY ELECTROSTATIC AIR FILTER DEVICE

[75] Inventors: Senichi Masuda, Tokyo; Naoki Sugita, Kawaguchi, both of Japan

[73] Assignee: Midori Anzen Co., Ltd., Tokyo, Japan

[21] Appl. No.: 231,603

[22] Filed: Feb. 5, 1981

[30] Foreign Application Priority Data

Jun. 5, 1980 [JP] Japan ..... 55-76021

[51] Int. Cl.[3] ..... B03C 3/00

[52] U.S. Cl. ..... 55/6; 55/132; 55/500

[58] Field of Search ..... 55/6, 131, 132, 138, 55/154, 155, 500

[56] References Cited

U.S. PATENT DOCUMENTS

| | | | |
|---|---|---|---|
| 2,297,601 | 9/1942 | Williams | 55/132 |
| 2,579,441 | 12/1951 | Palmer | 55/131 |
| 2,970,670 | 2/1961 | Nodolf | 55/138 |
| 3,242,649 | 3/1966 | Rivers | 55/132 |
| 3,997,304 | 12/1976 | Carr | 55/132 |

FOREIGN PATENT DOCUMENTS

| | | | |
|---|---|---|---|
| 2725190 | 12/1977 | Fed. Rep. of Germany | 55/131 |
| 892908 | 4/1962 | United Kingdom | 55/132 |

*Primary Examiner*—Bernard Nozick

*Attorney, Agent, or Firm*—Prutzman, Kalb, Chilton & Alix

[57] ABSTRACT

An improved high-efficiency electrostatic air filter device which has a high efficiency of dust collection and a long service life. The device is composed of a charging section having a plurality pairs of electrodes to charge the dust particles in the gas to be treated; and a dust collecting section which is provided with a corrugated filter medium and spacer electrodes that are disposed in the troughs of the corrugations of the filter medium, and one of each pair of the electrodes in the charging section and the spacer electrodes on one side of the filter medium in the dust collecting section are applied with high electric voltage.

6 Claims, 4 Drawing Figures

HIGH-EFFICIENCY ELECTROSTATIC AIR FILTER DEVICE

BACKGROUND OF THE INVENTION

1. Field of the Invention

This invention relates to an improved high-efficiency electrostatic air filter device. More particularly, the invention relates to an electrostatic air filter device for use in the cleaning of air in a room, which device has a very high efficiency and a long service life.

2. Description of the Prior Art

The so-called HEPA (high-efficiency particulate air filter) is widely used in the prior art. It has a high dust-collecting efficiency, however, the head loss is quite high when dust-laden gas is passed through the filter.

If the pores of the filter are made coarse in order to reduce the head loss, the efficiency of dust collection is lowered. If the head loss is decreased by reducing the velocity of the gas to be treated, the size of the filter must be increased. In addition, there have been other disadvantages in that the head loss is increased with the filling of pores, and that the life of the filter is short. Therefore, a suitable pre-filter is often employed in order to extend the life of such a filter.

BRIEF SUMMARY OF THE INVENTION

It is, therefore, the primary object of the present invention to provide an improved high-efficiency air filter device which is free of the above-described disadvantages.

Another object of the present invention is to provide an electrostatic air filter which is able to treat dust-laden gas with high efficiency without the need of a pre-filter.

A further object of the present invention is to provide an air filter device which has quite a long life and can be used for a long period of time without requiring any troublesome operations or maintenance work.

Still a further object of the present invention is to provide an air filter device which is compact but not complicated in structure and which does not require a large floor space.

Pursuant to the above object, in the embodiment of the electrostatic air filter device of the present invention, the suspended particles in the gas to be treated are electrically charged before the gas is passed through a filter medium; the charged particles are then collected on the surface of dust collecting electrodes that are disposed in the space formed by the filter medium to which a high electric voltage has been applied. The remaining particles are filtered off by the filter medium, thereby attaining a quite high efficiency of dust collection and a long service life.

BRIEF DESCRIPTION OF THE DRAWINGS

The nature, principle and details of the invention will be more clearly apparent from the following detailed description with respect to the preferred embodiment of the invention and the accompanying drawings, in which.

DESCRIPTION OF THE PREFERRED EMBODIMENT

Figure 1:
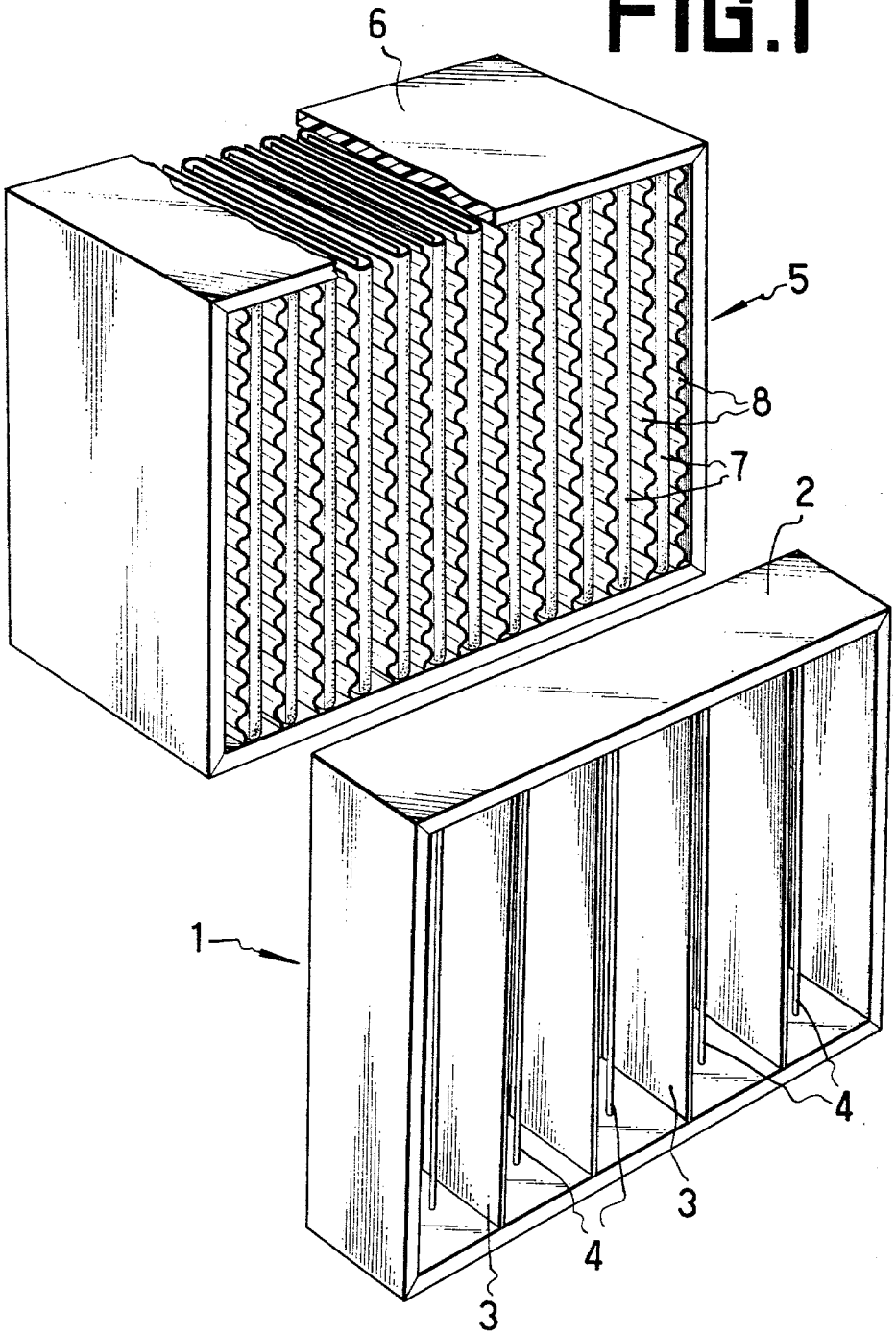
FIG. 1 is a perspective view of an embodiment of the air filter device of the present invention, wherein a charging section and a dust collecting section are separated so as to show their overall structure clearly.
Figure 2:
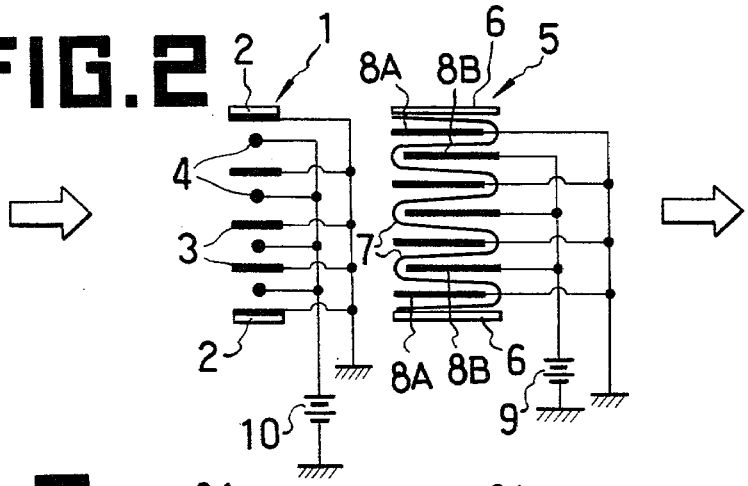
FIG. 2 is an electric circuit diagram of the same embodiment.

Referring now to the accompanying drawings, the present invention will be described in more detail.

The air filter device of the present invention is composed of a charging section 1 and a dust collecting section 5. The frame 2 of the charging section 1 is provided with a plurality of plate electrodes 3 that are disposed parallel to each other. Each of the plate electrodes 3 is grounded, and the plane of the electrode 3 is in parallel relationship with the direction of the air to be treated. In the spaces between the plate electrodes 3 are disposed charging electrodes 4 which are connected to a high d.c. voltage source 10.

A frame 6 of the dust collecting section 5 is provided with a filter medium 7 which is folded in a corrugated form. In the troughs of the corrugations at both the upstream side and the downstream side are provided spacer electrodes 8A and 8B which are made of, for example, corrugated metal sheets. The spacer electrodes 8A on the upstream side are grounded, and the other spacer electrodes 8B on the downstream side are connected to an electric power source 9 for applying a high voltage to them.

By connecting the outlet of the above-described charging section 1 to the intake of the dust collecting section 5, the improved high-efficiency electrostatic air filter device of the present invention can be formed. The charging section 1 and the dust collecting section 5 may be installed together in the same framework, if desired.

The operation of the above-described air filter device will now be explained.

Figure 3:
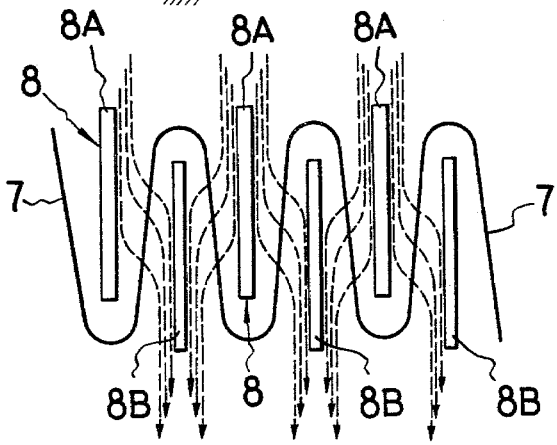
FIG. 3 is a schematic plan view of a part of the dust collecting section showing the state of the dust-laden gas current.

A high d.c. voltage of 1 kv to 3 kv is applied to the charging electrodes 4 and the spacer electrodes 8B on the downstream side. The dust-laden gas to be treated is supplied from the inlet of charging section 1, in which dust particles are electrically charged by corona discharge. The gas carrying the charged dust particles then passes through the dust collecting section 5, as indicated by the dash line arrows in FIGS. 3 and 4. In this process, most of the charged particles 13 are attracted to the spacer electrodes 8A on the upstream side, release their electric charge, and are deposited on the surfaces of the electrodes 8A. Thus, most of the dust particles in the treated gas are removed. The larger the particle size, the greater the effect of this dust removal action.

Figure 4:
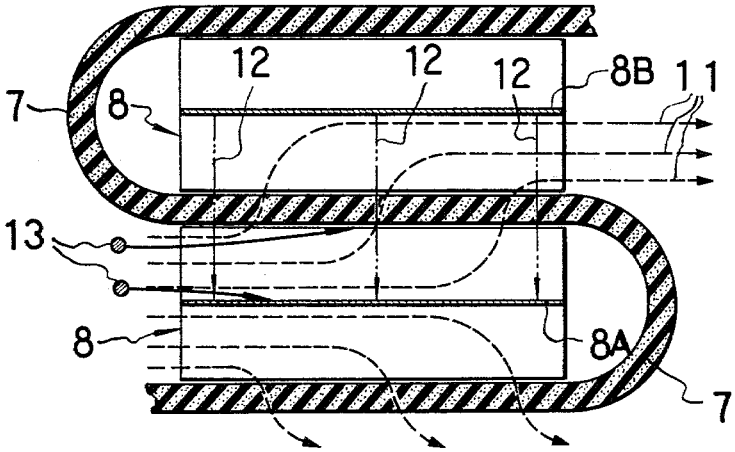
FIG. 4 is a schematic illustration of part of the dust collecting section showing the direction of the electric field and the directions of movement of the electrically charged particles when they are caused to pass through the filter medium.

Gas currents 11 containing the remaining charged particles 13 advance as shown by the arrow lines in the drawing, that is, the gas currents 11 pass across the filter medium 7 along the shortest path owing to the resistance of filtration. Therefore, as shown in FIG. 4, the gas currents 11 move parallel and opposite to lines of electric force 12 that are directed from the spacer electrode 8B to the spacer electrode 8A. At the same time, the velocity per unit cross-sectional area of the gas currents 11 through the filter medium 7 becomes very low as compared with the velocity on the upstream side of this dust collecting section 5. Since the direction of the electric field and the direction of the gas currents are opposite to each other, the charged particles 13 move oppositely to the direction of the gas currents. If the velocity of this opposite movement of the particles exceeds the velocity of the gas currents through the filter medium 7, the charged particles 13 cannot enter into the pores of filter medium 7. However, since the gas current velocity outside the filter medium 7 is large, the charged particles 13 are ultimately deposited in porous state on the surface of the filter medium 7. Furthermore, even when the charged particles 13 are received into the pores of the filter medium 7, they are deposited in porous state along the lines of the electric field applied by the spacer electrodes 8A and 8B, and are distributed through the fibers of the filter medium 7. Since the state of deposition of dust particles is porous, the amount of dust that is caught by the filter medium 7 is quite large as compared with the case in which dust particles are deposited irregularly on and in the filter medium 7.

With the above-described dust collecting mechanism, the efficiency of dust collection can be much improved, and clean gas can be obtained from the outlet of the dust collecting section 5. Further, since larger particles are more effectively removed, the filling of the pores of filter medium 7 hardly occurs, providing a much longer service life.

In connection with the efficiency of dust collection, the air filter device of the present invention has been tested in order to confirm the effectiveness of the device.

Test Method

Air supplied from a blower was cleaned by using a high efficiency particulate air filter to remove suspended fine particles of foreign substances. The cleaned air was then mixed with a suspension of fine DOP (dioctyl phthalate) particles obtained by using an aerosol suspension generator. The gas mixture thus obtained was passed through a current regulating lattice, an upstream density measuring section, a filtering test section and a downstream density measuring section, and the tested gas was discharged. Test samples were taken through a diluting device at the rate of 100 ml per 20 seconds from sampling tubes that were attached to the upstream density measuring section and the downstream density measuring section. The number of DOP particles was counted by a light-scattering particle counter. The efficiency of dust collection was calculated from the upstream particle density and the downstream particle density in accordance with the following formula. The upstream particle density of particles having diameters of 0.3 microns or more was about 5000/ml.

$$\text{Efficiency of dust collection } (\eta) = 1 - \frac{C_{out}}{C_{in}}$$

where Cin is the particle number at the upstream side before filtration and Cout is the particle number at the downstream side after filtration.

Test Results (Efficiency of Dust Collection)

| Items | Test 1 | Test 2 |
|---|---|---|
| Filter medium only | 99.997% | 97.7% |

-continued

| Items | Test 1 | Test 2 |
|---|---|---|
| Air filter device of the present invention | 99.999997% | 99.998% |
| Head loss (in both cases) | 25.4 mmAq | 8.5 mmAq |

From the above test results, it will be understood that when the air filter device of the present invention is used, the efficiency of dust collection can be perfected as much as 3 decimal places beyond the efficiency of the conventional case of a filter medium alone.

In the above-described embodiment, the corrugated electroconductive plates are used for the spacer electrodes 8A and 8B so as to define spaces between crests of the folded filter medium 7. However, if the filter medium 7 is made of a hard material, the spacer electrodes 8A and 8B may be made of flat plates because the trough spaces of the wave form of the filter medium 7 can be maintained by the rigidity of the material.

Further, in the above-described embodiment, the direction of the electric field between the spacer electrodes is opposite to the direction of the gas currents. It should be noted, however, that the direction of the electric field can be made the same as the direction of the gas currents or the former can be inclined relative to the latter. When the direction of electric field between the spacer electrodes is made the same as the direction of the gas currents, most of the charged particles are deposited in the pores of the filter medium.

In the above embodiment, when the electric voltage applied to the spacer electrodes is too high, sparks occur between the spacer electrodes to damage the filter medium. On the other hand, if the electric voltage is too low, the remakable improvement in dust collecting efficiency cannot be expected. Therefore, the electric voltage applied to the spacer electrodes may be on such a level that the velocity of movement of the charged particles in the direction of the lines of the electric field must be the same or larger than the velocity of the gas currents that pass through the filter medium. In order to comply with this requirement, it is necessary to reduce the velocity of the charged particles through the filter medium and, therefore, the filter medium is given a corrugated shape so as to enlarge its effective area.

In addition, if the electroconductive spacer electrodes 8B on the downstream side are wrapped with an insulating material, sparks can be avoided. Therefore, an intense electric field can be produced between the spacer electrodes and the efficiency of dust collection can be much improved. Furthermore, since the dust collection is quite effective, the density of dust on the downstream side is quite low. Thus, the lowering of the dust collection efficiency owing to collected dust on the surface of the above insulating material over the spacer electrodes can well be avoided.

In the air filter device of the present invention, the dust particles are electrically charged and then collected by three measures, on the spacer electrodes, on the surfaces of the filter medium and in the pores of the filter medium. In other words, the dust particles are preliminarily collected by the spacer electrodes, the remaining dust particles are collected on the surfaces of the filter medium, and the still remaining dust particles are finally deposited in the spaces among the fibers of the filter medium. Therefore, the air filter device of the present invention is capable of attaining a very high efficiency of dust collection as well as providing a long service life, which two effects are in confrict in the conventional art.

This comes from the three functions of the spacer electrodes: they maintain the spaces between the folded portions of the filter medium and mechanically reinforce the filter medium; they serve as dust collecting plates for the charged particles; and they serve as electrode plates to provide an electric field in the spaces between them and the filter medium and in the pores of the filter medium. The structure is different from conventional dust collecting devices, for example, the device in which the filter medium is wrapped in wire netting so as to generate an electric field within the filter medium, and electrodes are separately installed; or the device in which a double-step electric dust collector is separately attached at the upstream side.

According to the above-described three-stage dust collecting mechanism of the present invention, a quite high efficiency of dust collection can be attained as compared with the case in which an electric voltage is not applied. In addition, owing to the preliminary dust collecting effect by the spacer electrodes and the manner of dust deposition in the porous structure on the surface of filter medium, a quite effective air filter device can be obtained, in which the filling up of filter pores does not occur, and in which a very low head loss is provided.

Furthermore, as will be understood from the foregoing results of Test 2, it is possible to produce an air filter having a quite high efficiency of dust collection with very low head loss. In other words, when the efficiency of dust collection and the size of the device are made the same as those of conventional devices, it is possible to produce an air filter device having a large treating capacity.

Although the present invention has been described in connection with a preferred embodiment thereof, many variations and modifications will be apparent to those skilled in the art. It is preferred, therefore, that the present invention be limited not by the specific disclosure herein, but only by the appended claims.

What is claimed is:

1. In a high efficiency filtration method of electrostatically removing particles suspended within a gas by electrically charging the particles in the gas and then electrostatically filtering the charged particles from the gas with an electrostatic filter having a filter medium and an electrostatic field provided by electrodes upstream and downstream of the filter medium, the improvement wherein the electrostatic filtration of the charged particles from the gas comprises the successive steps of conducting the gas through a high voltage electrostatic field of at least one kilovolt between opposed spaced upstream and downstream electrodes by first conducting the gas between opposed spaced upstream surfaces of the filter medium and upstream electrode to slow down the suspended charged particles within the gas with the electrostatic field between the opposed spaced upstream and downstream electrodes and thereby enhance collection of the particles on at least one of said opposed upstream surfaces, then conducting the gas through the filter medium between said opposed surface of the upstream electrode and an opposed surface of the downstream electrode spaced from an opposed downstream surface of the filter medium to further slow down the suspended charged particles within the gas with the electrostatic field and thereby enhance collection of the particles within the filter medium, and then conducting the gas between said opposed downstream surfaces of the downstream electrode and filter medium.

2. A high efficiency electrostatic filtration method according to claim 1 wherein the suspended charged particles and upstream electrode have the opposite charge and the suspended charged particles are collected on both of said opposed upstream surfaces of the filter medium and upstream electrode.

3. A high efficiency electrostatic filtration method according to claim 1 or 2 wherein the filter medium is a sheet extending generally perpendicular to the electrostatic field.

4. A high efficiency electrostatic filtration method according to claim 1 or 2 wherein said upstream and downstream surfaces of the upstream and downstream electrodes respectively are generally imperforate and the electrodes have a corrugated shape engaging the upstream and downstream surfaces of the intermediate filter medium to provide a plurality of upstream and downstream gas channels on the upstream and downstream sides of the filter medium, wherein the first of said successive steps comprises conducting the gas along the upstream gas channels between opposed spaced upstream surfaces of the filter medium and upstream electrode, and wherein the third of said successive steps comprises conducting the gas along the downstream gas channels between opposed spaced downstream surfaces of the filter medium and downstream electrode.

5. In a high efficiency electrostatic air filtration device for electrostatically removing suspended particles and having upstream precharging means for precharging the suspended particles and a downstream electrostatic filter with a filter medium and an electrostatic field provided by electrodes upstream and downstream of the filter medium for electrostatically filtering the precharged particles from the air as the air is conducted through the electrostatic filter, the improvement wherein the filter medium is formed to provide upstream and downstream air flow channels between the filter medium and the upstream and downstream electrodes respectively and wherein the electrostatic filter comprises upstream and downstream electrodes providing a high voltage electrostatic field of at least one kilovolt and with a direction opposite to the direction of flow through the filter medium and having opposed upstream and downstream electrode surfaces spaced from the upstream and downstream surfaces respectively of the filter medium by said air flow channels whereby the precharged particles are filtered from the air in the upstream air flow channels between the opposed spaced upstream surfaces of the filter medium and upstream electrode with the electrostatic field slowing down the precharged particles to enhance collection of same on at least one of said opposed upstream surfaces, by the filter medium between said opposed surfaces of the upstream and downstream electrodes with the electrostatic field slowing down the remaining precharged particles to enhance collection of same within the filter medium, and in the downstream air flow channels between said opposed downstream surfaces of the downstream electrode and filer medium.

6. The high efficiency electrostatic air filtration device according to claim 5 wherein said upstream precharging means is operable for precharging the suspended particles with a positive charge and the upstream electrode of the electrostatic filter has a negative charge.

* * * * *